US010487563B2

(12) United States Patent
Quaiser

(10) Patent No.: US 10,487,563 B2
(45) Date of Patent: Nov. 26, 2019

(54) MAINTENANCE SYSTEM FOR MONITORING A GATE DEVICE AND METHOD FOR MONITORING A GATE DEVICE

(71) Applicant: FRABA B.V., SG Heerlen (NL)

(72) Inventor: Andre Quaiser, Bonn (DE)

(73) Assignee: FRABA B.V., SG Heerlen (NL)

( * ) Notice: Subject to any disclaimer, the term of this patent is extended or adjusted under 35 U.S.C. 154(b) by 120 days.

(21) Appl. No.: 15/572,789

(22) PCT Filed: Mar. 8, 2016

(86) PCT No.: PCT/EP2016/054913

§ 371 (c)(1),
(2) Date: Nov. 9, 2017

(87) PCT Pub. No.: WO2016/180556

PCT Pub. Date: Nov. 17, 2016

(65) Prior Publication Data

US 2018/0119476 A1 May 3, 2018

(30) Foreign Application Priority Data

May 12, 2015 (DE) ..... 10 2015 107 416

(51) Int. Cl.
*E05D 15/06* (2006.01)
*E05F 15/73* (2015.01)
(Continued)

(52) U.S. Cl.
CPC ..... *E05F 15/73* (2015.01); *E05F 15/40* (2015.01); *E05F 15/632* (2015.01); *E05F 15/668* (2015.01); *E05F 15/60* (2015.01); *E05Y 2400/10* (2013.01); *E05Y 2400/44* (2013.01); *E05Y 2400/458* (2013.01); *E05Y 2400/54* (2013.01); *E05Y 2400/55* (2013.01); *E05Y 2900/106* (2013.01); *E05Y 2900/132* (2013.01)

(58) Field of Classification Search
CPC ..... E05F 15/57; E05F 15/668; E05F 15/40; E05F 15/73; E05F 15/60; E05F 15/59;
(Continued)

(56) References Cited

U.S. PATENT DOCUMENTS 7,034,487 B1 * 4/2006 Murphy ..... G05B 19/4061 318/466
7,289,014 B2 * 10/2007 Mullet ..... E05F 15/668 340/12.28

(Continued)

FOREIGN PATENT DOCUMENTS

DE 42 31 816 C3 10/1996
EP 1 972 751 A2 9/2008

*Primary Examiner* — Chi Q Nguyen
(74) *Attorney, Agent, or Firm* — Norman B. Thot

(57) ABSTRACT

A maintenance system for monitoring a gate device includes the gate device having a gate guide, a gate segment which is movably supported in the gate guide, and a sensor which monitors a gate guiding quality. A method for monitoring the gate device includes the gate device having a gate guide, a gate segment which is movably supported in the gate guide, a sensor which monitors a gate guiding quality arranged at the gate segment, and a maintenance unit. The method includes, when a movement of the gate segment occurs, detecting a vibration value and/or an acceleration value of the gate segment via the sensor, and transmitting the vibration value and/or the acceleration value as maintenance data to the maintenance unit.

14 Claims, 2 Drawing Sheets

(51) Int. Cl.
*E05F 15/632* (2015.01)
*E05F 15/668* (2015.01)
*E05F 15/40* (2015.01)
*E05F 15/60* (2015.01)

(58) Field of Classification Search
CPC .. E05F 15/665; E05F 15/00; E05Y 2900/106; E05Y 2900/132; E05Y 2400/10; E05Y 2400/44; E05Y 2400/458; E05Y 2400/55; E05Y 2400/54
USPC .... 49/404; 340/5.7, 5.71, 5.1, 5.2, 5.61, 5.3, 340/5.21
See application file for complete search history.

(56) References Cited

U.S. PATENT DOCUMENTS 7,994,896 B2 * 8/2011 Fitzgibbon ..... E05F 15/77 340/5.22
8,400,264 B2 * 3/2013 Mullet ..... G07C 9/00182 340/5.26
8,643,465 B2 * 2/2014 Fitzgibbon ..... G07C 9/00182 340/5.64
2003/0023881 A1 * 1/2003 Fitzgibbon ..... G07C 9/00182 726/2
2005/0012631 A1 * 1/2005 Gregori ..... G07C 3/00 340/686.1
2005/0057340 A1 * 3/2005 Fitzgibbon ..... G07C 9/00182 340/5.71
2005/0156546 A1 * 7/2005 Keller ..... E05F 15/40 318/280
2005/0253710 A1 * 11/2005 Eskildsen ..... G08B 13/08 340/545.5
2006/0183457 A1 8/2006 Fitzgibbon
2008/0164973 A1 * 7/2008 Mamaloukas ..... G07C 9/00309 340/5.7
2008/0231441 A1 9/2008 Schafer
2010/0325959 A1 * 12/2010 De Coi ..... E06B 9/88 49/25
2012/0299699 A1 * 11/2012 Siegesmund ..... E05F 15/60 340/5.7

* cited by examiner

MAINTENANCE SYSTEM FOR MONITORING A GATE DEVICE AND METHOD FOR MONITORING A GATE DEVICE

CROSS REFERENCE TO PRIOR APPLICATIONS

This application is a U.S. National Phase application under 35 U.S.C. § 371 of International Application No. PCT/EP2016/054913, filed on Mar. 8, 2016 and which claims benefit to German Patent Application No. 10 2015 107 416.8, filed on May 12, 2015. The International Application was published in German on Nov. 17, 2016 as WO 2016/180556 A1 under PCT Article 21(2).

FIELD

The present invention relates to a maintenance system for monitoring a gate device, in particular the functionality of a door device, comprising a gate device having a gate guide and at last one gate segment movably supported in the gate guide. The present invention further relates to a method for monitoring such a gate device.

BACKGROUND

Gate devices are known in various embodiments from the prior art. Gates are known, for example, which have a gate segment or gate wing adapted to be pivoted sideways, which, for guiding, is movably supported on hinges and/or in rails. Gates are also known that have a gate segment that is movable in a substantially vertical direction, in particular roller gates or sectional gates where the gate segment is most often supported in a guide rail. Such gate devices are in particular used in building closures or property closures. For opening and closing a gate segment, the gate devices may comprise a motor drive or a device for manual operation, for example, a chain pull or a rope pull.

Depending on the field of application and the use of such a gate device, accretions, dirt and other obstacles, for example, between the gate guide and the movable gate segment, may lead to an impairment of the mobility of the gate segment over time. Besides impairments caused by environmental influences, other reasons, such as damage or tampering, may also impair gate functionality. Examples include a rope pull that has come off the pulley or a guide wheel which has a flattened portion caused by temporary blocking.

The result of such impairments of the gate device is mostly that the actual function, i.e., opening and closing the gate segment, can still be performed, but that an increased physical effort for moving the gate segment is required. Such impairments, in particular with motor driven gates, often remain unnoticed or ignored and are only realized when the gate becomes totally blocked or during one of the next maintenance services for the gate. The impairments mentioned may, however, have a negative effect on the functionality, the safety, and the service life of the gate device already after a short time. Irreparable damage may thereby be done to the gate guide, the gate support and/or the gate drive. The impairments may, as already mentioned above, also lead to a complete blocking of the gate and thus to a total loss of functionality of the gate device, for example, when the gate segment has jammed or has become stuck due to an object in the gate guide. In the instances mentioned above, this may cause undesirable, long outage times or down times of the gate device. Opening and closing the gate or passing the gateway is then no longer possible. This may cause substantial economic damage to a user, for example, a shipping company.

Gate devices are therefore nowadays serviced at regular intervals, with the servicing interval being set to short enough to almost exclude a total loss of functionality due to an impairment by environmental influences or minor damage. Such servicing and manual monitoring of the gate functions, in particular of the functions relevant to safety, is, however, time-consuming and expensive.

SUMMARY

An aspect of the present invention to provide a system and a method by which the servicing interval for a gate device is extended and the downtime reduced in case of necessary repairs while maintaining the safety level and functionality. A further aspect of the present invention is to lower manufacturing and maintenance costs for such a gate device.

In an embodiment, the present invention provides a maintenance system for monitoring a gate device which includes the gate device having a gate guide, at least one gate segment which is movably supported in the gate guide, and a sensor which is configured to monitor a gate guiding quality. The present invention also includes a method for monitoring a gate device. The gate device thereby includes a gate guide, at least one gate segment which is movably supported in the gate guide, a sensor which is configured to monitor a gate guiding quality arranged at the at least one gate segment, and a maintenance unit. The method includes, when a movement of the at least one gate segment occurs, detecting at least one of a vibration value and an acceleration value of the at least one gate segment via the sensor; and transmitting the at least one of a vibration value and an acceleration value as maintenance data to the maintenance unit.

BRIEF DESCRIPTION OF THE DRAWINGS

The present invention is described in greater detail below on the basis of embodiments and of the drawings in which.

DETAILED DESCRIPTION

Figure 1:
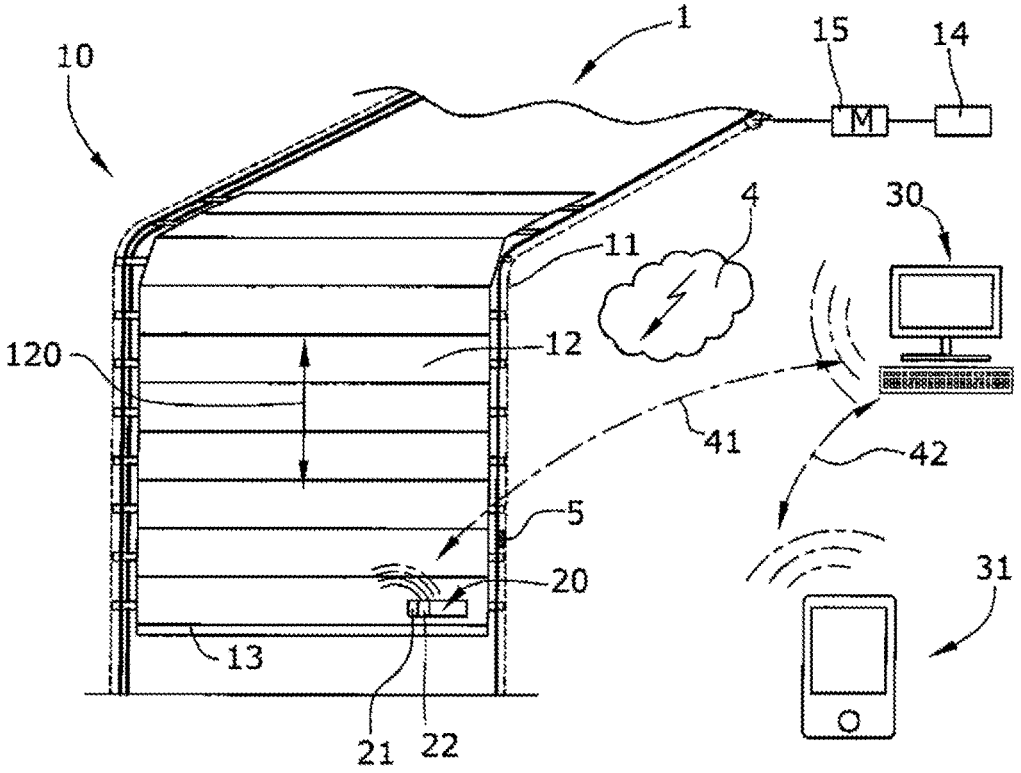
FIG. 1 shows an embodiment of a maintenance system according to the present invention in a schematic illustration.

In an embodiment of the present invention, the maintenance system comprises a gate device having a sensor for monitoring the gate guiding quality. The sensor is in particular suited to detect and monitor the functionality of the gate device or of the gate. The term "gate guiding quality", and thereby also the term "functionality", in particular refers to the mobility of the gate segment in the gate guide. This in particular includes a degree of friction between the gate segment and the gate guide and/or a degree of wear of the bearing components of the gate. The gate guiding quality can advantageously be monitored by detecting measuring values during the movement of the gate segment, for example, by measuring vibrations or an acceleration of the gate segment during movement. The measuring values detected by the sensor are further matched with predefined set values, such as a vibration, acceleration, or a time value. A number of opening and closing cycles, as well as irregularities or impairments of the gate device, can thereby be detected rather quickly, further damage to the gate device can be prevented, and/or servicing, maintenance or repair of the gate device can be ordered based on individual needs and in a timely manner. Regular maintenance times can also be set at larger intervals since the functionality of the gate guiding quality of the gate device is continuously monitored.

The sensor can, for example, be arranged at the gate segment so that the behavior of the gate segment during movement, i.e., during opening and closing, can be detected with particular precision by the sensor and can be used in monitoring the gate guiding quality. The sensor can, for example, be operated using batteries so that a complex current supply, such as a cable which is moved along, is not necessary.

The sensor can, for example, be designed as a vibration sensor and/or an acceleration sensor so that it is possible to in particular detect gate vibrations and/or gate accelerations in a relatively simple manner using the sensor. Impairments, such as, for example, unevennesses or other interferences with the gate guide, can accordingly be detected in a particularly quick manner.

For an increase in the safety of the gate device, as well as for an increase in the measuring accuracy of the sensor, the sensor may be connected to a safety device and/or a gate control device. The safety device may be a safety-relevant sensing device, for example, a light barrier sensor or an inclination sensor. The gate control device may be an electronic control apparatus for controlling or stopping a drive motor. The gate control may alternatively be a mechanical latch which may enable or prevent a manual operation of the gate, especially with gates without a drive motor. Due to the advantageous connection between the sensor and the safety device or the gate control device, signals may be transmitted to the sensor, which, for example, include information about the present operational state of the gate device. A signal is, for example, transmitted to the sensor for a desired or controlled starting or stopping of the gate segment which regularly cause vibrations and an acceleration of the gate segment. It is thus possible to avoid misinterpretation in a sensor measurement during a start and stop process of a gate movement. The sensor may thereby also receive a signal for activation or deactivation so that the sensor is activated only during a gate movement and only then requires energy. The sensor may also transmit a signal to the safety device and/or the gate control device. For example, when detecting a malfunction of the gate or a safety-relevant event, the sensor may transmit a signal to the gate control device to stop the gate segment so that a further movement of the gate can be halted and thus damage to the gate device or to an obstacle in the movement path of the gate segment prevented. It is also possible that the sensor can monitor the functionality of the other safety device and/or of the gate control device, or, in the event of a failure of a safety device, can at least temporarily assume the function thereof. Another advantage is that different sensors for detecting the gate guiding quality can be connected to each other and that a common detection result can be obtained, for example, from the measuring values of a vibration sensor that detects vibrations during the movement of the gate segment, and from the measuring values of an inclination sensor that motors the inclination of a closing edge of the gate.

The sensor can advantageously be configured to detect a bumping of the gate segment against an obstacle or vice versa. The number of safety sensors for monitoring a danger zone in the movement range of the gate segment can thereby be reduced, whereby the manufacturing costs for the gate device can also be reduced. Detecting a bumping may be effected, for example, by detecting an unexpected, in particular a negative acceleration, of the gate segment. In the present instance, "unexpected" means that, at the moment of detection, the sensor had not been sensitized by a signal including information about a start or stop of the gate segment.

In order to differentiate whether dirt, wear, damage or a bumping of the gate segment against an obstacle exists, the sensor may comprise an evaluation unit by which a measuring value can be compared to a set value within the sensor. The set value may comprise at least one threshold value, with the sensor triggering a signal when the threshold value is exceeded by the measuring value. The sensor may, for example, output a signal to report a malfunction when the sensor detects a measuring value which exceeds a predefined threshold value.

The sensor may advantageously comprises a transmitter unit by which the sensor may be coupled to a central maintenance means via a data link for transmission of maintenance data. The sensor may thereby be suited to transmit a signal or data to a maintenance device. The coupling or connection between the sensor and the maintenance device may be permanent or may be established repeatedly at a certain time interval. The coupling may be provided to last for a certain time during which the sensor can transmit maintenance data to the maintenance device. The sensor may comprise an integrated transmitter unit for transmitting the maintenance data so that a separate transmitting unit is not required. In an embodiment of the present invention, the sensor can, for example, have a transmitter and receiver unit via which the data is not only be transmitted by the sensor, but is also be received by the sensor. It is thereby possible, for example, to update or adjust the set values which are necessary for comparing the measuring values in a relatively simple manner in the sensor. In an embodiment of the present invention, it is, for example, provided that the maintenance data transmitted to the maintenance means are automatically routed to a mechanic, in particular to a terminal of a mechanic, by the maintenance device. A mechanic can be ordered very quickly for maintenance work and the downtime of the gate device can be minimized as a result of this flow of information from the sensor directly to the terminal of a mechanic via the maintenance device. The terminal of a mechanic may, for example, be a beeper, a pager, a laptop, a smart phone, or a tablet PC.

The data link for the transmission of maintenance data to the maintenance device may be a network link, an internet link, or a mobile communications link. An already existing wired or wireless connection may thereby be used so that the manufacture, assembly, and operation of the system is relatively economic.

The maintenance data can advantageously include a gate identification, a malfunction message and/or measuring values such as vibration and/or acceleration values. All data required for maintenance and calculating the urgency of the maintenance can thereby be transmitted to the maintenance means. The maintenance data may in addition optionally include a serial number, a gate position, a gate type, hardware information, a number of closing cycles and/or an operational state of the gate device. The maintenance means may thus be provided with further information about the respective gate, which information may be advantageous to evaluate the gate guiding quality or for a subsequent maintenance or a for the scope of maintenance work to be expected. It is in particular possible to calculate from these data a next required maintenance time or an individual maintenance interval in the maintenance device.

The present invention also provides a method for monitoring a gate device. The gate device comprises a gate guide and at least one gate segment movably supported in the gate guide and has a sensor for monitoring a gate guiding quality arranged at the gate segment. The method provides that, upon a movement of the gate segment, vibration values and/or acceleration values of the gate segment are detected by the sensor, and that the detected vibration values and/or acceleration values are thereafter transmitted to a maintenance unit. A next maintenance time can thereby be calculated in the maintenance unit in a quick and relatively simple manner. In particular when a poor gate guiding quality or an impairment of the gate movement is detected, an immediate order for maintenance work on the gate device can be initiated in order to avoid further damage to the gate device.

In an embodiment of the present invention, for the detection of the number of gate movements, a detection of time can, for example, also be performed when the vibration value and/or the acceleration value are detected. The vibration values and/or the acceleration values may in particular additionally be detected as a function of time so that it is possible to detect the number of gate movements, in particular the number of complete opening and closing processes of the gate segment. For this purpose, the maintenance system may be suited to detect the vibrations that regularly occur during the gate travel as a function of time and, for example, to increase a memory value by one each time a complete gate movement is detected. In the present context, the term "complete" means that the gate has been moved from an open position, in which the gate is completely open, to a closed position, in which the gate is completely closed, or vice versa. The memory value may thus indicate the number of complete gate movements or of the gate cycles. After detection of a number of gate cycles, the sensor can, for example, be able to learn from evaluating the time required for a complete gate movement how long the sensor will detect vibrations and/or accelerations during a complete gate movement, and it may, on this basis, detect and count up individual gate cycles. A message indicating the necessity of a regular maintenance may be issued when a predetermined number of gate cycles is exceeded. This message may be linked to an output of information about the gate cycle number detected, the necessary work, and the material required to perform the maintenance work, such as springs, helical wires, or the like.

The sensor may basically continuously transmit all detected data to the maintenance means, wherein, in this case, an evaluation or comparison of the measuring values, i.e., of the vibration values and/or the acceleration values, to predetermined set values in the maintenance means can, for example, be performed. The sensor may here have a relatively simple structure and requires neither an evaluation unit for matching the measuring values with set values, nor a memory for, for example, the predetermined set values. It has proven to be advantageous, however, that the measuring values are compared in the sensor to the predetermined set values even before transmitting the maintenance data, and that the measuring values are transmitted to the maintenance means only when it is detected that a measuring value exceeds a respective predefined first threshold value. In this manner, the maintenance unit receives maintenance data, in particular only when the set values predefined from the sensor, are exceeded and a maintenance of the gate device has become necessary according to the specifications in the sensor. When no detection is made or the detected vibration value and/or the acceleration value does not exceed a respective predetermined first threshold value, the transmission of the maintenance data is at least delayed in time. It is thereby possible to avoid an unnecessary transmission of data and an unnecessary energy consumption associated therewith. It is also considered advantageous that the sensor, after the detected vibration value and/or acceleration value have been detected to exceed the threshold value, regularly transmits all future detected measuring values to the maintenance unit so that the maintenance unit can determine, in a relatively simple manner, a deterioration or possibly also an improvement of the situation, for example, in case of an erroneous detection, and a subsequent maintenance time can be adjusted thereto. The maintenance data can, for example, be stored in the maintenance unit therefor.

In an embodiment of the present invention, the detected values can, for example, be transmitted from the sensor to the maintenance unit at a predefined interval, which interval may depend on time or on a number of closing cycles. The sensor can, for example, transmit the maintenance data to the maintenance unit once a day or after every tenth opening of the gate segment. It should be understood that the kind, the time, or the extent of the data transmission may be varied so that, in this respect, the sensor can be adapted individually to the wishes of a user.

By transmitting the maintenance data from the sensor to the maintenance unit, it is advantageously possible to use the maintenance unit to determine a next maintenance time and/or a future maintenance interval for the gate device. It is in particular possible by transmitting and by continuously storing the maintenance data of a plurality of gate devices to establish a chronological profile of the gate guiding quality for each gate device. By comparing the data and by detecting irregularities, it is possible to calculate a degree of deterioration of the door guiding quality and to gain knowledge with respect to future maintenance necessity. The maintenance effort for the gate device can thereby be lowered drastically.

In an embodiment of the present invention, the method provides that upon detection of the detected vibration value and/or acceleration value exceeding a respective predefined second threshold value, which can, for example, be higher than the first threshold value, a triggering signal can, for example, be outputted to a gate controller to stop the gate movement and malfunction data can, for example, be transmitted to the maintenance unit. Malfunction data in particular has a higher processing priority than the maintenance data. Further damage to the gate device can thereby be averted and an immediate maintenance order can be initiated so that the down time of the gate device can be reduced drastically.

After the maintenance data has been transmitted to the maintenance unit, an order and/or a transmission of the data are advantageously transmitted from the maintenance unit to a mobile terminal. A mechanic can thus directly be ordered for maintenance work so that the downtime of the gate device can be reduced further.

The present invention will be described in detail below with reference to an embodiment and to the accompanying drawings.

FIG. 1 schematically illustrates a maintenance system 1 for a gate device 10. In the present instance, the maintenance system 1 in particular comprises the gate device 10, a maintenance unit 30, as well as a first data link 41 between the gate device 10 and the maintenance unit 30.

The gate device 10 has a gate frame or a gate guide 11 in which a gate segment 12, a roller gate in the present case, is supported for displacement. The gate device 10 has a drive motor 15 for moving 120 the gate segment 12, in particular for an up and down movement of the gate segment 12 to open or close a gateway. The drive motor 15 is controlled by a gate controller 14 which, in the present instance, is a motor control device. In an alternative embodiment of the gate device 10 (not illustrated herein), a chain pull for manual operation can be provided instead of the drive motor 15, although the gate controller 14 would also be suited in such an embodiment to enable or block a movement 120 of the gate segment 12. In order to monitor a danger zone formed during the movement 120 of the gate segment 12, in particular below the gate segment 12, for possible obstacles, the gate device 10 has a safety device 13 at the lower edge of the gate segment 12. The safety device 13 may be designed, for example, as a closing edge safety device having an optical transceiver unit (not illustrated in detail in FIG. 1).

The gate device 10 has a sensor 20 arranged at the gate segment 12, i.e., in the present instance, in the region of the safety device 13. The sensor 20 is suited to detect an impairment of the gate guiding quality during the movement 120 of the gate segment 12. For this purpose, the sensor 20 is, in the present case, designed as a vibration and/or acceleration sensor and is adapted in particular to detect vibrations and/or accelerations of the gate segment 12. To do so, the sensor 20 continuously detects measuring values 200, in particular vibration and acceleration measuring values 200. The detection can be made in a plurality of directions at the same time, for example, in a vertical and in a horizontal direction.

The sensor 20 presently has a transmitter unit 21, as well as an evaluation unit 22. The evaluation unit 22 is connected upstream of the transmitter unit 21 and allows matching the measuring value 200 detected by the sensor 20 with a predefined set value 203. The set value 203 may, for example, form a predefined upper acceleration limit value up to which a movement of the gate segment 12 is considered safe. When the set value 203 is exceeded, the evaluation unit 22 may issue a signal, for example, a trigger signal 24 for stopping the gate movement 120.

As illustrated in FIG. 1, an obstacle 5 is present in the gate guide 11 of the gate device 10. In the present instance, the obstacle 5 is a small stone wedged in the gate guide 11. The gate segment 12 can basically still be moved, but a suspension thereof will rub along the stone or obstacle 5 as it passes the site of the obstacle 5. The free mobility of the gate segment 12 is thus affected, which condition is detected by the sensor 20 due to the increase in vibrations and transverse accelerations of the gate segment 12. If the evaluation unit 22 determines during the matching of the detected measuring value 200 with the predefined set value 203 that the measuring value 200 exceeds a predefined first threshold value 201, the evaluation unit 22 outputs a signal for the transmission of maintenance data 25 to the transmitter unit 21. Should the measuring value 200 even exceed a predefined second threshold value 202, the evaluation unit 22 outputs a signal for the transmission of malfunction data 25 to the transmitter unit 21.

The transmitter unit 21 is adapted to establish the first data link 41 to the maintenance unit 30 via an already existing mobile communications network 4. For this purpose, the transmitter unit 21 may comprise a so-called SIM (Subscriber Identity Module) card by which a link to the mobile communications network 4 can be established and which may in addition serve as a non-temporary memory for storing at least one detected measuring value 200. Maintenance data 25 and/or malfunction data 26 that include information about the door guiding quality can be transmitted from the sensor 20 to the maintenance unit 30 via the first data link 41.

The maintenance data 25 transmitted by the sensor 20 in particular includes a gate identification, as well as the measuring values 200 detected by the sensor 20. This enables an allocation of the maintenance data 25 to a particular gate device 10, as well as a storing of the measuring values 200 in a memory 32. The malfunction data 26 in particular includes a gate identification, the detected measuring values 200, as well as a report on an existing malfunction. It is thereby possible to allocate the malfunction data 26 to a certain gate device 10, as well as to quickly order a mechanic for repair of the gate device 10. The transmitted malfunction data 26 can optionally include additional information about a serial number, a gate position, a number of closing cycles, or an operational condition of the gate device so that further information can be made available to the maintenance unit 30.

In the present instance, the maintenance unit 30 is a computer with a maintenance data store 32 and a network interface to the mobile communications net 4. All received measuring values 200, maintenance data 25 and/or malfunction data 26 are stored in the maintenance data memory 32. This data may be used to evaluate the gate guiding quality. The maintenance unit 30 is connected to a mobile maintenance receiver device 31 via a second data link 42. The maintenance receiver device 31 is in particular a hand-held device of a mechanic who is advantageously working near the location of the gate device 12. As soon as a necessary maintenance or repair of the gate device is detected in the maintenance unit 30 by an analysis of the received measuring values 200, an order 33 for maintenance or repair work can be transmitted immediately to the mobile maintenance receiver device 31.

Figure 2:
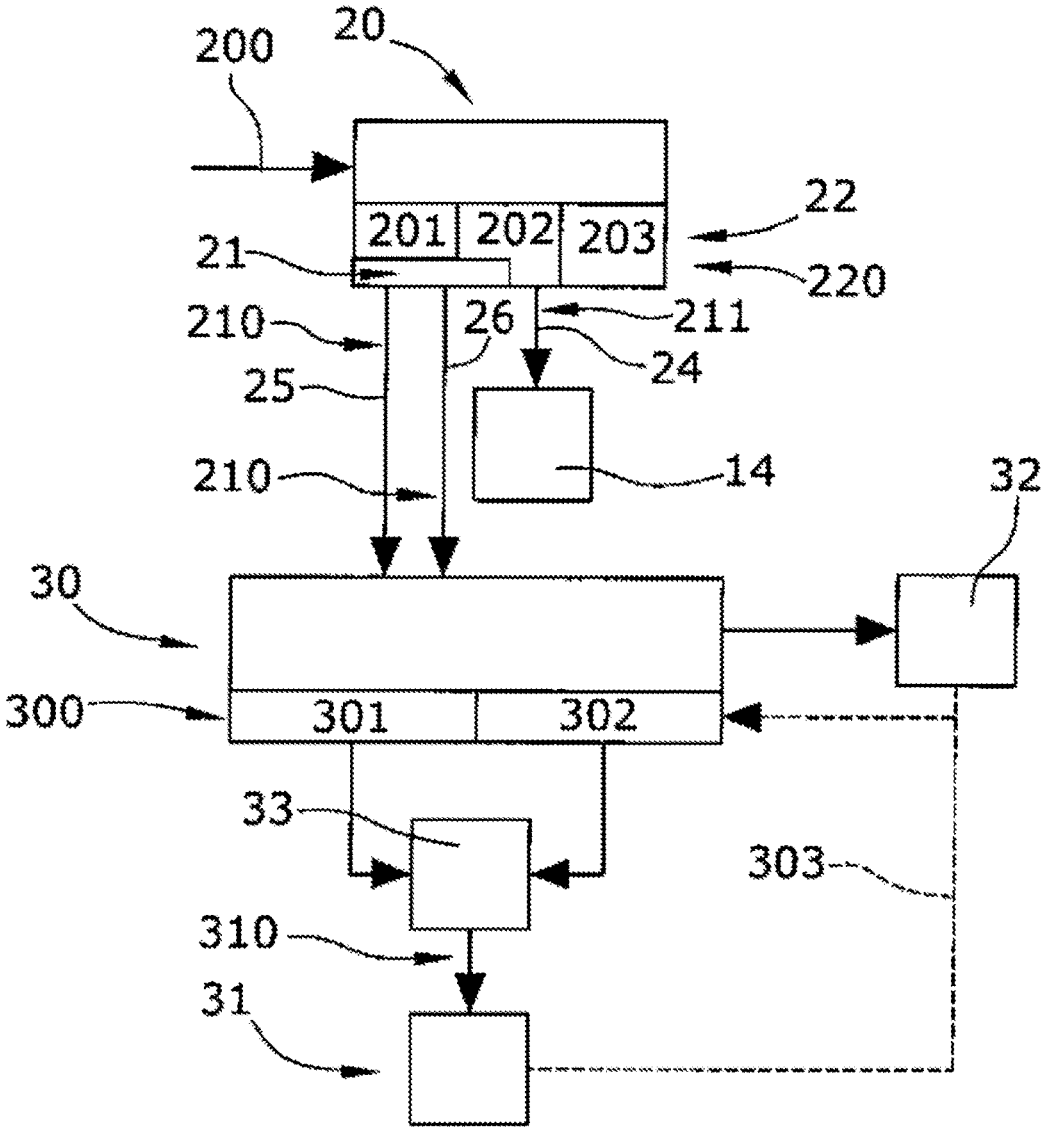
FIG. 2 shows an embodiment of a method according to the present invention in a schematic illustration.

FIG. 2 schematically illustrates the monitoring of the gate device 10 which may be executed as follows:

When the drive motor 15 is excited by the gate controller 14, the sensor 20 is activated by an activation signal, which activation signal includes information about the gate segment 12 being controlled to be closed 120. The sensor 20 is thus ready to detect measuring values 200, in particular in a continuous manner, until the sensor 20 receives another signal, namely a stop signal including information about stopping the closing operation 120. The starting and stopping of the gate segment 12 is detected by the sensor 20 as an acceleration of the gate segment 12, but is considered as a usual process, not as an unexpected vibration. The sensor 20 further uses the activation signal and the stop signal for a chronological monitoring of the gate movement 120 and/or for counting a gate cycle number, for example, for matching with a predefined or learned time value for a regular complete gate movement 120. The sensor 20 may in particular use a duration of the movement 120 from the activation signal as the predefined set value for a movement 120 of the gate segment 12. A predefined value of a chronological difference between the vibration at the stopping of the gate and the stop signal can also be used in the evaluation. However, when passing the obstacle 5, the gate segment 12 in the present instance is caused to vibrate unexpectedly, in particular with a lateral offset, and is thereby accelerated horizontally, which acceleration is detected by the sensor 20.

The detected measuring values 200 are each compared to a predefined set value 203 in the sensor 20. If the detected measuring values 200 exceed a first threshold value 201, the sensor 20 outputs an activation signal to the transmitter unit

21 for transmitting maintenance data 25 to the maintenance means 30. The sensor 20 can alternatively transmit the detected measuring values 200 directly to the maintenance means 30 via the transmitter unit 21 without any matching with a predefined set value 203. The measuring values 200 are thus transmitted by the transmitter unit 21 in the form of maintenance data 25 to the maintenance means 30 via the first data link 41 and the mobile communications network 4, which process is identified as 210.

Should the obstacle 5 cause such a measuring value 200 in the sensor 20 that not only exceeds the first threshold value 201, but also the second threshold value 202 which is higher than the first threshold value 201, the sensor 20 activates the transmitter unit 21 for transmission of malfunction data 26 and additionally outputs a trigger signal 24 to the gate controller 14 to stop the gate movement 120, which is identified as 211. Further travel 120 of the gate segment 12 is thereby prevented. After the obstacle 5 has been removed, a method, as known from other safety devices, may be executed, for example, a re-enabling of the mobility 120 of the gate segment 12.

The maintenance data 25 or malfunction data 26 transmitted by the sensor 20 are stored in a memory 32 in the maintenance unit 30, and are again compared to predefined set values 301, 302, the set value 302 being higher than the set value 301. The matching process is identified as 300 in FIG. 2. The urgency of a maintenance or repair can thereby be analyzed. The set values 301, 302 may be updated set values that are not necessarily identical with the set values 201, 202. Such an updating of the set values may result, for example, from a feedback 303 from a mechanic after maintenance or repair or from an analysis and development of the measuring values 200, 201, 202 stored in the memory 32.

Should the new check and analysis of the measuring values 200 in the maintenance unit 30 result in determining the necessity of a maintenance or repair, an order 33 for a maintenance or repair is generated and transmitted to a mechanic via a second data link 42, which operation is identified as 310. The order 33 is here in particular in electronic form and comprises all data necessary for maintenance or repair, for example, the gate identification, as well as technical gate data.

The present invention is not limited to embodiments described herein; reference should be had to the appended claims.

LIST OF REFERENCE NUMERALS

1 maintenance system
10 gate device
11 gate guide, gate frame
12 gate segment
13 safety device, closing edge safety device
14 gate controller
15 drive motor
20 sensor
21 transmitter unit
22 evaluation unit
24 trigger signal
25 maintenance data
26 malfunction data
30 maintenance unit
31 maintenance receiver device
32 data memory
33 order
4 mobile communications network
41 first data link
42 second data link
5 obstacle
120 movement of the gate segment (arrows)
200 measuring values
201 first threshold value
202 second threshold value
203 set value
210 sending, transmission of maintenance or malfunction data
211 sending, transmission of a trigger signal
220 matching of set and actual value
300 matching of set and actual value
301 first threshold value
302 second threshold value
303 feedback, re-analysis
310 sending of an order

What is claimed is:

1. A maintenance system for monitoring a gate device, the maintenance system comprising:
a gate device, the gate device comprising,
a gate guide,
at least one gate segment which is movably supported in the gate guide, and
a sensor which is configured to monitor a gate guiding quality, the sensor comprising an evaluation unit which is configured to compare a measuring value to a set value.

2. The maintenance system as recited in claim 1, wherein the sensor is arranged at the at least one gate segment.

3. The maintenance system as recited in claim 1, wherein the sensor is designed as at least one of a vibration sensor and an acceleration sensor.

4. The maintenance system as recited in claim 1, further comprising:
a safety device; and
a gate controller,
wherein,
the sensor is connected to at least one of the safety device and the gate controller.

5. The maintenance system as recited in claim 1, wherein the sensor is further configured to detect a collision of at least one the gate segment with an obstacle or a collision of the obstacle with the at least one gate segment.

6. The maintenance system as recited in claim 1, further comprising:
a central maintenance unit; and
a data link,
wherein,
the sensor further comprises a transmitter unit which is configured to connect the sensor with the central maintenance unit via the data link to transmit maintenance data.

7. The maintenance system as recited in claim 6, wherein the data link is a network link, an internet link, or a mobile communications link.

8. The maintenance system as recited in claim 6, wherein the maintenance data comprises at least one of a gate identification, a malfunction message, and a measuring value.

9. A method for monitoring a gate device,
the gate device comprising
a gate guide,
at least one gate segment which is movably supported in the gate guide, a sensor which is configured to monitor a gate guiding quality, the sensor being arranged at the at least one gate segment, and a maintenance unit, the method comprising, when a movement of the at least one gate segment occurs:

detecting at least one of a vibration value and an acceleration value of the at least one gate segment via the sensor;

comparing the at least one of a vibration value and an acceleration value detected to a predefined set value;

transmitting the maintenance data when the at least one of a vibration value and an acceleration value detected exceeds a respective predefined first threshold value;

delaying the transmitting of the maintenance data when the at least one of a vibration value and an acceleration value detected does not exceed the respective predefined first threshold value; and transmitting the at least one of a vibration value and an acceleration value as maintenance data to the maintenance unit.

10. The method as recited in claim 9, wherein, during the detecting of the at least one of a vibration value and an acceleration value of the at least one gate segment via the sensor, the method further comprises:

detecting a time in order to record a number of gate movements.

11. The method as recited in claim 9, wherein the transmitting of the maintenance data is performed in a predefined time interval.

12. The method as recited in claim 9, wherein, after the transmitting of the maintenance data, the method further comprises:

determining at least one of a next maintenance time and a future maintenance interval for the gate device.

13. The method as recited in claim 9, wherein, the gate device further comprises a gate controller, and prior to the transmitting of the maintenance data, the method further comprises:

comparing the at least one of a vibration value and an acceleration value detected to the predefined set value and, when the at least one of a vibration value and an acceleration value detected exceeds a respective predefined second threshold value;

transmitting a trigger signal to the gate controller to stop the movement of the at least one gate segment; and transmitting the at least one of a vibration value and an acceleration value detected to the maintenance unit as malfunction data.

14. The method as recited in claim 13, wherein, after the transmitting of at least one of the maintenance data and the malfunction data to the maintenance unit, the method further comprises:

transmitting at least one of an order and a routing of the at least one of the maintenance data and the malfunction data from the maintenance unit to a mobile terminal.

* * * * *